US011639568B2

(12) United States Patent
Egener

(10) Patent No.: US 11,639,568 B2
(45) Date of Patent: May 2, 2023

(54) NEEDLING MACHINE AND NEEDLING PROCESS

(71) Applicant: AUTEFA Solutions Austria GmbH, Linz (AT)

(72) Inventor: Paul Michael Egener, Linz (AT)

(73) Assignee: AUTEFA Solutions Austria GmbH, Linz (AT)

( * ) Notice: Subject to any disclaimer, the term of this patent is extended or adjusted under 35 U.S.C. 154(b) by 0 days.

(21) Appl. No.: 17/526,604

(22) Filed: Nov. 15, 2021

(65) Prior Publication Data

US 2022/0154376 A1 May 19, 2022

(30) Foreign Application Priority Data

Nov. 16, 2020 (DE) ..... 20 2020 106 554.8

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 5/02; D04H 13/005; D05C 11/06; D05B 3/025; D05B 3/02
USPC ..... 28/114, 115, 113
See application file for complete search history.

(56) References Cited

U.S. PATENT DOCUMENTS

| | | | | |
|---|---|---|---|---|
| 5,548,881 | A * | 8/1996 | Ludwig | D04H 18/02 28/114 |
| 6,785,940 | B1 * | 9/2004 | Muller | D04H 18/00 28/107 |
| 8,099,840 | B2 * | 1/2012 | Reutter | D04H 18/00 28/114 |
| 2006/0048356 | A1 * | 3/2006 | Leger | D04H 18/02 28/113 |
| 2006/0288549 | A1 * | 12/2006 | Jean | D04H 18/02 28/107 |
| 2010/0242240 | A1 * | 9/2010 | Reutter | D04H 18/02 28/107 |
| 2011/0179611 | A1 * | 7/2011 | Reutter | D04H 18/02 28/107 |

(Continued)

FOREIGN PATENT DOCUMENTS

| | | |
|---|---|---|
| DE | 69304208 T2 | 1/1997 |
| DE | 19650697 A1 | 6/1998 |

(Continued)

*Primary Examiner* — Amy Vanatta
(74) *Attorney, Agent, or Firm* — McGlew and Tuttle, P.C.

(57) ABSTRACT

An needling machine and process needle a nonwoven fibrous web (2) fed in a direction of passage (3). A needling unit (5) with oscillatingly moved needles (11) is configured to needle and strengthen the nonwoven fibrous web (2). The needling unit (5) has a lifting drive (6) and parallel, linearly guided driving rods (15, 16) driven reversably thereby. The needling unit (5) has a supporting beam (8) connected to the needles (11) and extending in the direction of passage (3). Driving rods (15), arranged one after another in the direction of passage (3), are each connected to the supporting beam (8) via a respective beam bearing (18, 19) in an articulated manner. One of the beam bearings (18, 19), arranged one after another in the direction of passage (3), has an additional degree of freedom of motion.

20 Claims, 9 Drawing Sheets

(56) References Cited

U.S. PATENT DOCUMENTS

| | | | | |
|---|---|---|---|---|
| 2012/0167361 | A1* | 7/2012 | Reutter | D04H 18/02<br>28/107 |
| 2018/0258567 | A1* | 9/2018 | Dilo | D04H 1/46 |
| 2018/0355528 | A1* | 12/2018 | Leger | D04H 18/02 |
| 2021/0332513 | A1* | 10/2021 | Demange | D04H 18/02 |
| 2021/0332514 | A1* | 10/2021 | Demange | D04H 18/02 |

FOREIGN PATENT DOCUMENTS

| | | | |
|---|---|---|---|
| DE | 10046163 | A1 | 5/2001 |
| DE | 10355590 | A1 | 6/2005 |
| DE | 202012100066 | U1 * | 4/2013 |
| EP | 2250308 | B1 | 9/2011 |
| WO | 2009127520 | A1 | 10/2009 |

* cited by examiner (PRIOR ART)

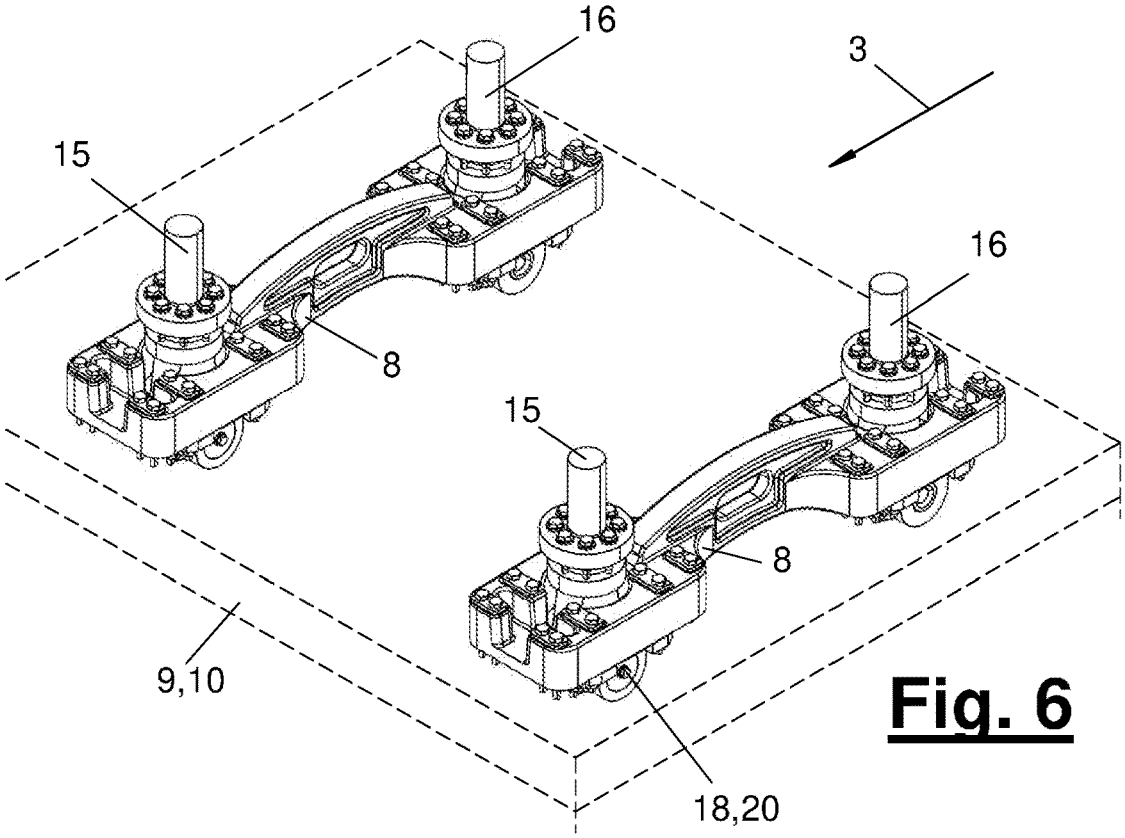
Fig. 6
Fig. 7
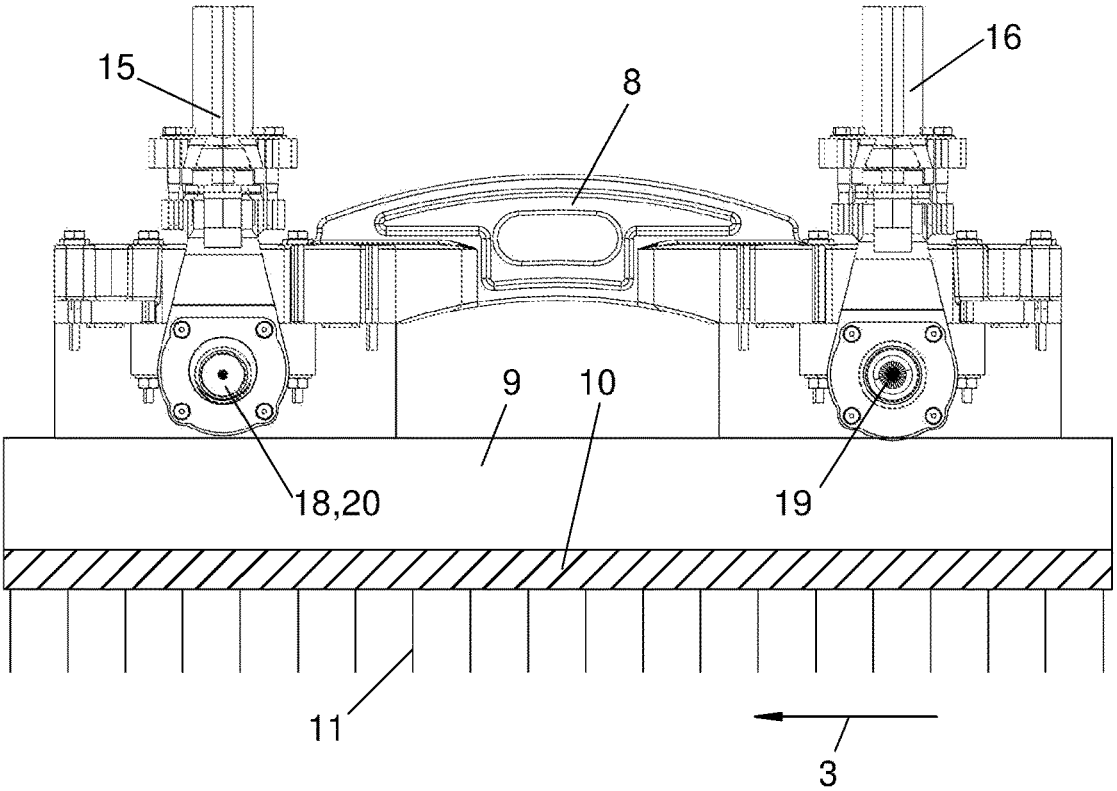

NEEDLING MACHINE AND NEEDLING PROCESS

CROSS REFERENCE TO RELATED APPLICATIONS

This application claims the benefit of priority under 35 U.S.C. § 119 of German Application DE 20 2020 106 554.8, filed Nov. 16, 2020, the entire contents of which are incorporated herein by reference.

TECHNICAL FIELD

The present invention pertains to a needling machine and to a needling process for a nonwoven fibrous web fed in a direction of passage, wherein the needling machine has a needling unit with oscillatingly moved needles for needling and strengthening the nonwoven fibrous web.

TECHNICAL BACKGROUND

Such a needling machine for a nonwoven fibrous web has been known from practice and is shown in FIG. 1. It has a needling unit with oscillatingly moved needles for the insertion, needling and strengthening of the nonwoven fibrous web. The needling unit has a lifting drive and parallel, linearly guided driving rods driven thereby in a reversing manner for moving the needles. The needles perform a straight and oscillating motion in the lifting direction in the process. The driving rods, which are oriented now parallel to the lifting direction with their longitudinal axes, are also moving in this lifting direction. The needles are inserted in the process at right angles to the nonwoven fibrous web being fed and moved at right angles to the lifting direction.

A needling machine with crank mechanisms and with needle bars connected directly to the connecting rods thereof, wherein a transverse motion is superimposed to the vertical lifting motion of the needle bar by an additional horizontal drive, is known from DE 196 50 697 A1.

A further developed variant of such a needling machine with lifting drive and with crank mechanisms as well as with a supporting beam for needles, which said supporting beam is connected directly in an articulated manner to the connecting rods thereof, is known from WO 2009/127520 A1. A horizontal motion is superimposed to the vertical lifting motion of the supporting beam by a connecting rod mechanism.

SUMMARY

An object of the present invention is to provide an improved needling technology.

The present invention accomplishes this object with the features according to the needling machine and process of the invention.

The needling technology being claimed, i.e., the needling machine and the needling process, have various advantages.

The needling unit of the needling machine has a supporting beam, which is connected to the needles, extends in the direction in which the nonwoven fibrous web passes through, and is directly or indirectly connected to the needles. The driving rods, which are driven by the lifting drive in a reversing manner and are guided linearly, are connected to the supporting beam via a respective beam bearing each in an articulated manner. One of the beam bearings has an additional degree of freedom. The lifting drive may have any freely selectable structural configuration and drive the driving rods in a reversing manner in any desired manner and can allow them to perform an oscillating, preferably vertical lifting motion.

The supporting beam can change its orientation and position relative to the parallel driving rods thanks to the additional degree of freedom of motion at a beam bearing. It can be oriented especially obliquely to the driving rods and to the longitudinal axis thereof as well as to the lifting direction, which is parallel hereto. This has advantages, especially when the driving rods are moved with a mutual phase shift ($\alpha$) and are driven by the lifting drive. This makes possible a motion of the needles in the lifting direction with a superimposed additional needle motion in the direction in which the nonwoven fibrous web passes through. The superimposed needle motion in the direction of passage can support the transportation of the nonwoven fibrous web.

The needles, especially the needle tips, can now have especially an elliptical path of motion. The needles can be inserted into the nonwoven fibrous web upstream when viewed in the direction of passage and then leave the fibrous web again downstream. This makes possible for the needles a motion component in the direction of passage, which is favorable for a low incidence of collisions and disturbances and for the removal of the needles at the moving nonwoven fibrous web. Disturbances in the fibrous web structure, e.g., a moiré effect, can be avoided. The quality of the strengthened nonwoven fibrous web is very high.

The nonwoven fibrous web may be formed from natural fibers or synthetic fibers or fiber blends. It may be, e.g., a single-layer or multilayer fibrous nonwoven, which is fed to the needling machine by a nonwoven layering apparatus, especially by a crosslayer. The nonwoven layering apparatus can fold, e.g., a fiber pile produced by a formed fabric generator, e.g., by a card or card engine, an airlay or the like into a multilayer fibrous nonwoven and deposit it on a discharging conveyor.

The design and control effort of the needling machine is low and is lower than in the state of the art mentioned in the introduction. A possibility for phase adjustment at the lifting drive and/or at the driving rods is sufficient. The supporting beam with the needles then adjusts itself to the phase-shifted driving rod motion. No additional horizontal drive and/or connecting rod mechanism is necessary for the desired motion of the supporting beam.

On the other hand, the parallel driving rods, which are arranged one after another in the direction of passage, have the advantage that they can absorb and support the transverse forces occurring during the operation especially well. This can take place with low wear and interference. On the other hand, the configuration of the articulated beam bearing between the driving rods and the supporting beam can also be simplified and improved. The bearing loads can be kept low.

The beam bearing arranged at the supporting beam downstream in the direction of passage advantageously has the additional degree of freedom of motion. The other beam bearing arranged upstream may be configured as a simple hinge. These beam bearings absorb the transverse forces occurring especially well together with the associated driving rod. This is especially advantageous in case of a phase shift, because the center of gravity of the mass of supporting beams, needle board, etc., which mass is suspended at the driving rods, is likewise moving along an elliptical path. Two driving rods and two beam bearings are arranged at the supporting beam in an advantageous embodiment.

There are different possibilities of configuration for the configuration of the additional degree of freedom of motion at one of the beam bearings. Only one individual additional degree of freedom of motion is preferably present. As an alternative, there may be several.

The additional degree of freedom of motion may be a degree of freedom of rotatory or translatory motion. The beam bearing in question may be configured, e.g., as an eccentric bearing. The beam bearing in question may be configured, e.g., as an eccentric bearing with an additional degree of freedom of rotatory motion or as a sliding bearing with an additional degree of freedom of translatory motion. The degree of freedom of translatory motion may be oriented in the longitudinal direction of the supporting beam and along the direction of passage of the nonwoven fibrous web.

A straight and preferably upright guide, especially a linear guide, is advantageous for the driving rods. The guide and the longitudinal axis of the driving rods extend in the lifting direction. They are preferably oriented vertically. The guide may be optimized for the tilt-free guiding of the driving rods and for the absorption of transverse forces, e.g., by two or more separate mounting and guiding points located at spaced locations in the longitudinal direction of the rod.

The needling unit may have two or more supporting beams with driving rods and with said beam bearings, which are arranged in a direction at right angles to the direction of passage one after another. The lifting drive may be adapted to such a multiple arrangement.

The needles may be arranged directly or indirectly at the supporting beam. In an advantageous embodiment, they are arranged at a needle board, which is preferably mounted detachably at the needle bar. The needle bar and the needle board may extend at right angles to the one or more supporting beams and at right angles to the direction of passage. This configuration makes possible an especially stable and torsion-free supporting structure for the needles.

The lifting drive can drive the driving rods in their motion direction in the same direction, and said phase shift a may be present. The phase shift may be able to be set and adjusted. A phase adjuster may be arranged for this purpose at the lifting drive or at another location. There are various possibilities for configuring the lifting drive.

The lifting drive may have a separate driving mechanism each for the driving rods arranged one after another in the direction of passage. This may be configured in an advantageous embodiment as a crank mechanism preferably rotating in a circulating manner. Such a crank mechanism may have, e.g., a rotating crank shaft with a disk-shaped cam and with a connecting rod. The connecting rod may be mounted rotatably at one end via a connecting rod bearing at the cam and be connected via a hinge to the corresponding driving rod at the other end. On the other hand, a crank mechanism may also have a crank shaft bent at right angles with connection of the connecting rod at the right-angle bend.

The lifting drive may have a separate drive motor each for the driving mechanisms. In another embodiment, it may have a common drive motor for a plurality of driving mechanisms. A power take-off gear or the like can transmit the driving force of the motor to the driving mechanisms. When a plurality of supporting beams with driving rods are arranged one after another at right angles to the direction of passage, a separate driving mechanism may be present for each driving rod, and the driving mechanisms arranged one after another in the transverse direction may have a common crank shaft. These common crank shafts may be coupled in the above-mentioned manner with separate motors or with a common motor. Said motors may have any desired and suitable configuration, preferably as controllable electric motors, especially a.c. or three-phase motors.

The needling machine may have a plurality of needling units arranged one after another in the direction of passage. These make possible a multistage needling and strengthening of the nonwoven fibrous web. As an alternative or in addition, the needling machine may have a plurality of needling units arranged on both sides of the nonwoven fibrous web. These may be arranged especially above and under the nonwoven fibrous web. They make possible a two-sided needling and strengthening of the nonwoven fibrous web. The two-sided needling units may operate and insert their needles at the nonwoven fibrous web with a phase shift in order to avoid collisions.

One or more needling units being claimed may be arranged at the inlet area of the needling machine when viewed in the direction of passage in case of a multistage needling machine. One or more following needling units may be configured in the conventional manner. They may operate, in particular, with a simply straight, especially vertical insertion and removal motion of the needles.

The present invention is shown in the drawings schematically and as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 6 is a schematic perspective view of a plurality of supporting beams and driving rods arranged at right angles to one another in the direction of passage;

FIG. 7 is an enlarged front view of a supporting beam with a beam bearing configured as an eccentric bearing with an additional degree of freedom of motion;

DESCRIPTION OF PREFERRED EMBODIMENTS

Figure 1:
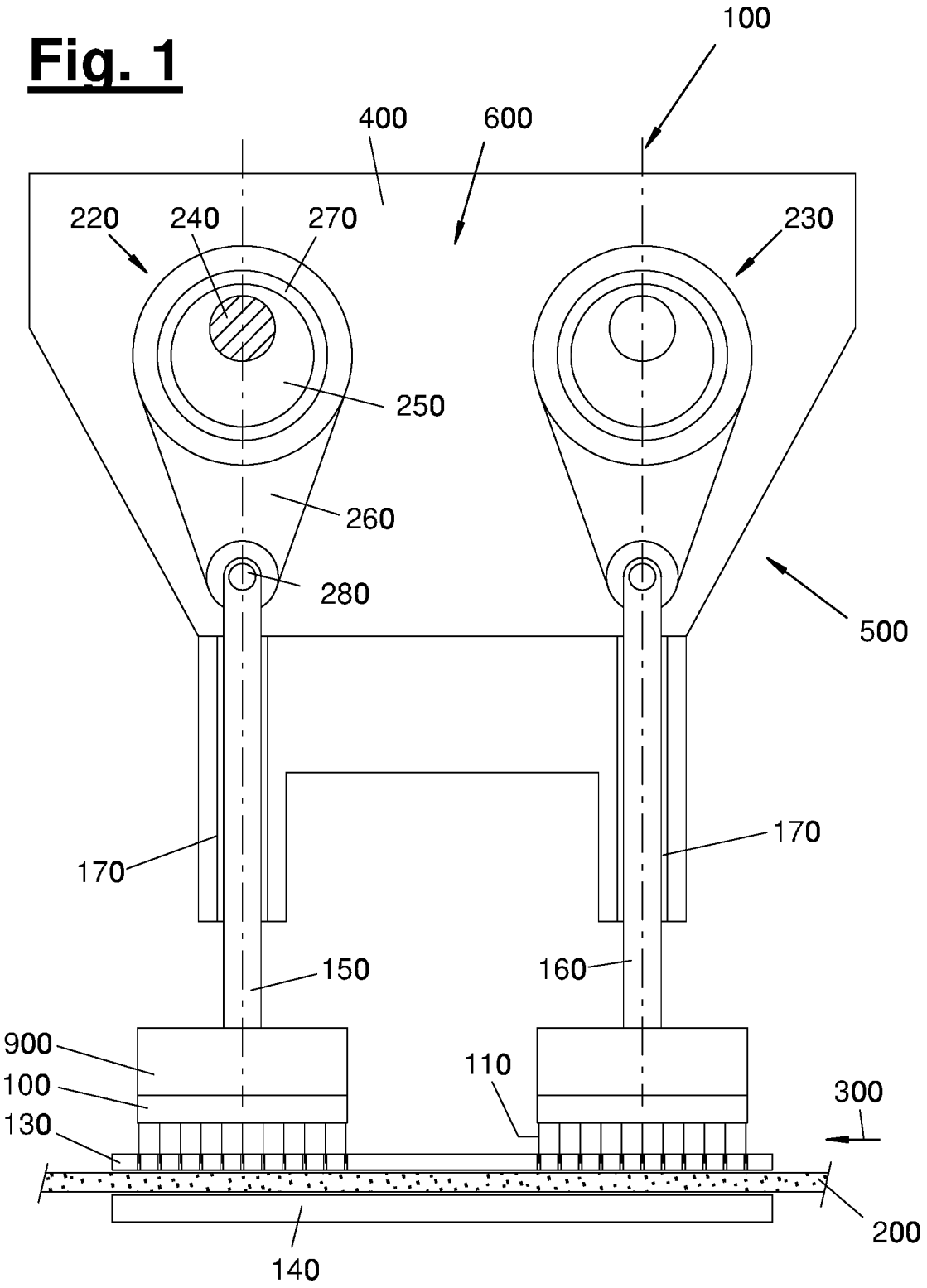
FIG. 1 is a schematic view showing a needling machine according to the state of the art.

Referring to the drawings, the present invention pertains to a needling machine (1) and to a needling process for needling and strengthening a nonwoven fibrous web (2).

FIG. 1 shows a needling machine (100) according to the state of the art for needling and strengthening a nonwoven fibrous web (200), which is fed to the needling machine (100) in a direction of passage (300) and is passed through the needling machine (100).

The needling machine (100) has at least one needling unit (500) with oscillatingly moved needles (110) for needling and strengthening the nonwoven fibrous web (200). The needling unit (500) comprises a lifting drive (600), which drives by a reversing motion two parallel driving rods (150, 160) guided along a straight path in a respective linear guide (170). The driving rods (150, 160) perform a synchronous oscillating, e.g., vertical lifting motion.

The driving rods (150, 160) are connected at one end, e.g., at the upper end, to the lifting drive (600) and are connected at their respective other end, especially at their lower end, to the needles (110). In the embodiment shown, a respective needle bar (900) each with an, e.g., replaceable needle board (100) and with needles (110) mounted there is arranged at said ends of the driving rods (150, 160). The needle bars (900) and the needles (1100) extend at right angles over the nonwoven fibrous web (200) and at right angles to the direction of passage (300). The lifting motion and the insertion motion of the needles (110) are directed at right angles to the nonwoven fibrous web (200) and to the direction of passage (300).

The lifting drive (600) has, according to FIG. 1, two driving mechanisms (220, 230), which are configured as a crank drive each and have a rotatingly driven crank shaft (240) and a cam (250) mounted hereon. Further, the crank mechanisms have a connecting rod (260) each, which is connected in an articulated manner at one of its ends, e.g., at its lower end, to the associated driving rod (150, 160) via a hinge (280). The connecting rod (260) is connected via a connecting rod bearing (270) to the cam (250) at the other end. During a rotatory motion of the crank shaft (240) and of the cam (250), the connecting rods (260) perform each a lifting and lowering motion directed along the driving rods (150, 160) as well as a superimposed pivoting motion. The nonwoven fibrous web (200) is preferably guided along a straight line and, e.g., horizontally between a perforated stripper (130) and a stitching base (140). The above-mentioned components of the needling unit (500) are arranged in a machine frame (400) of the needling machine (100). The needling unit (500) may further have driving units (220, 230), which are arranged at right angles to the direction of passage (300) and to the drawing plane one after another at a common crank shaft (240) and are driven thereby together.

Figure 2:
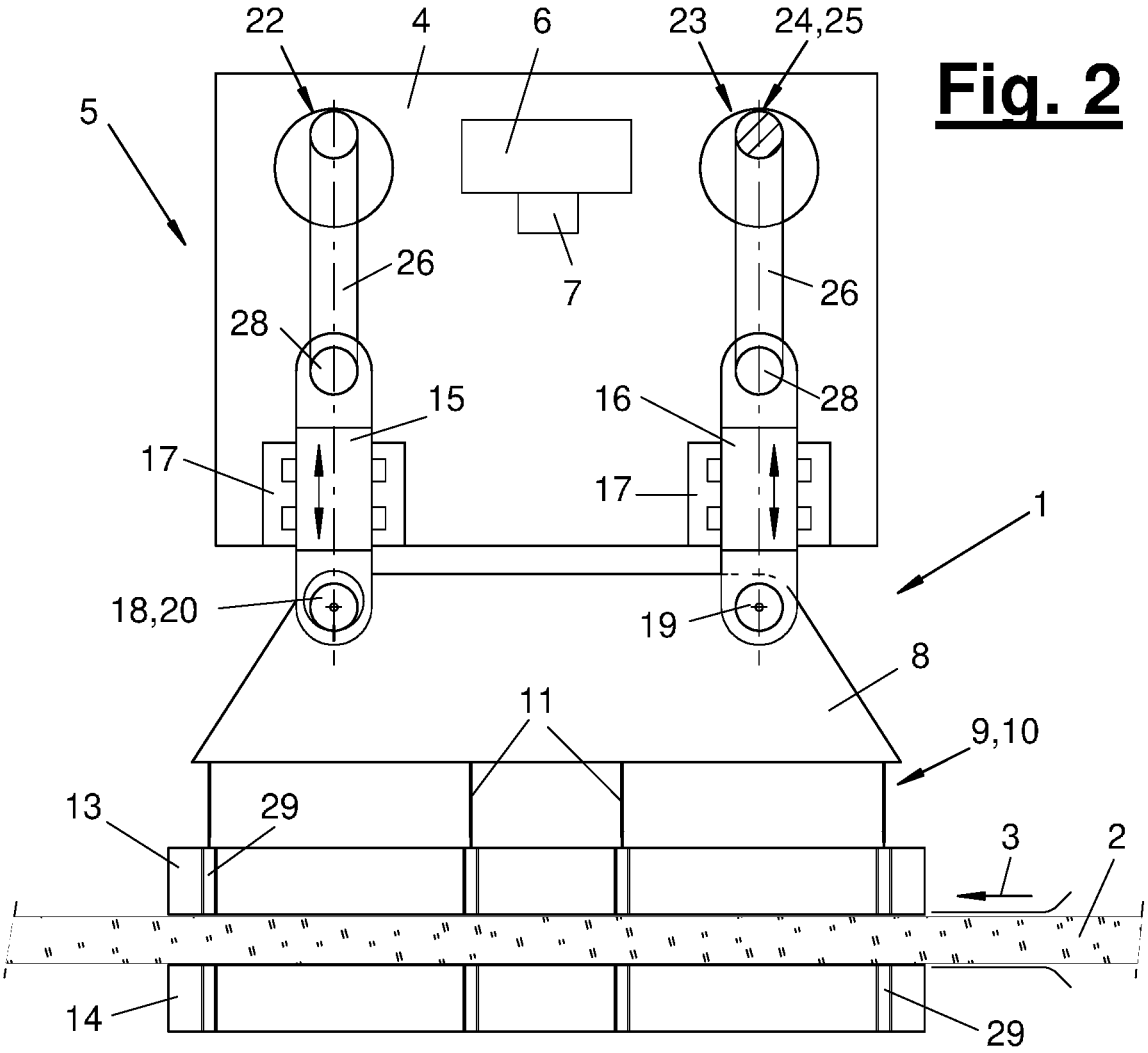
FIG. 2 is a schematic front view of a needling machine according to the present invention with lifting drive, with driving rods, with supporting beam and with a beam bearing with an additional degree of freedom of motion in a first operating position.
Figure 3:
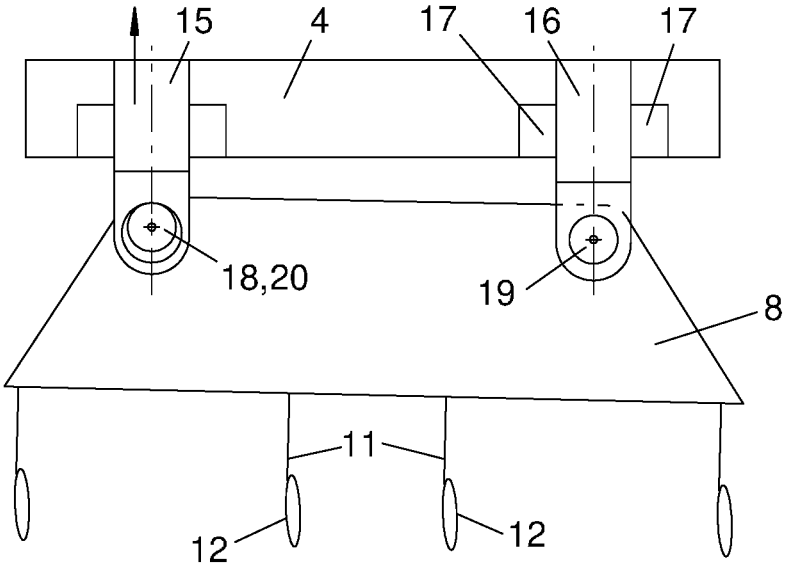
FIG. 3 is a schematic front view showing the supporting beam and the driving rods along with needles in another operating position with phase shift of the driving rods as well as with elliptical path of motion of the needles.
Figure 4:
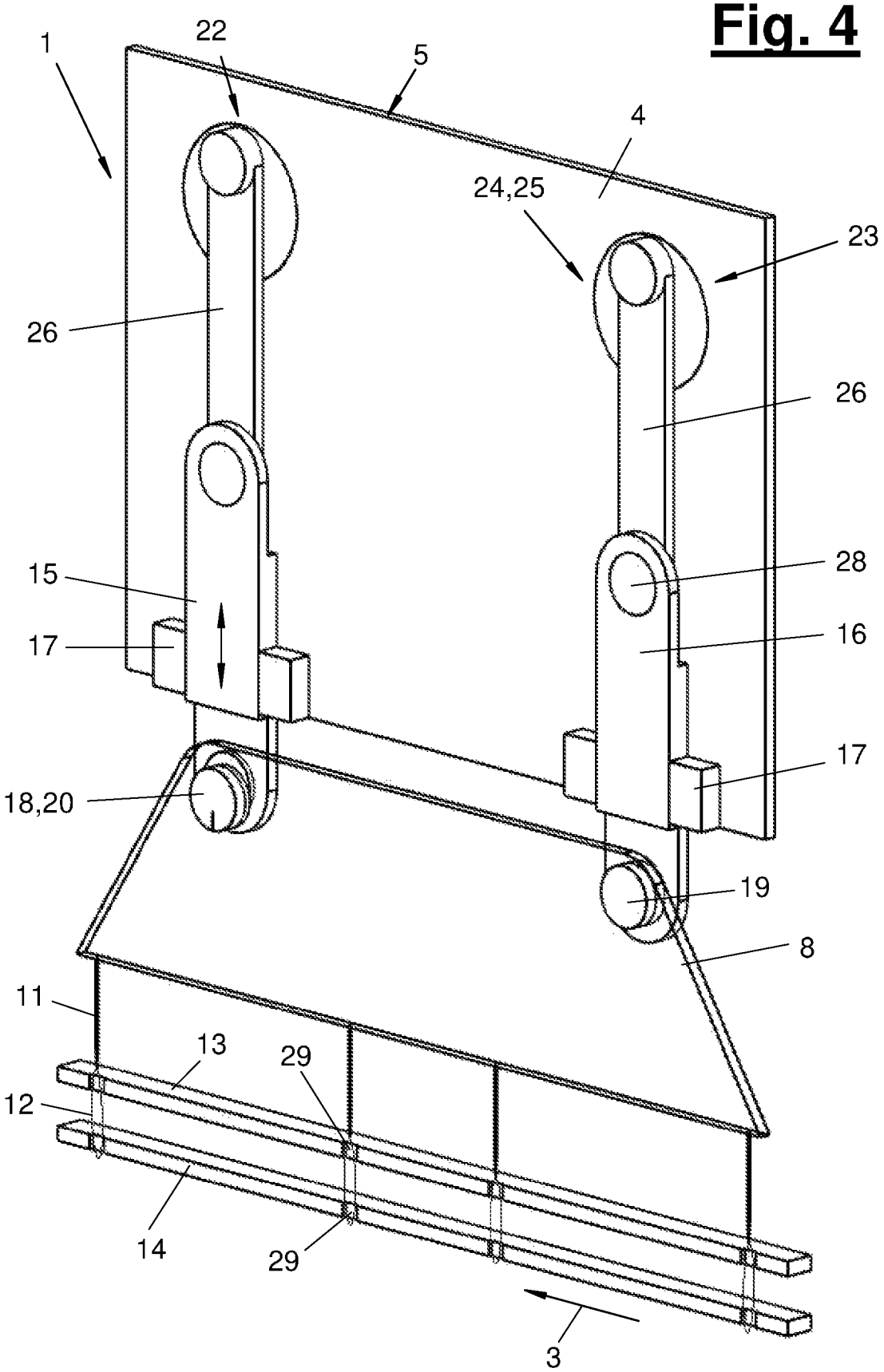
FIG. 4 is a schematic perspective view of the arrangement from FIG. 2.
Figure 5:
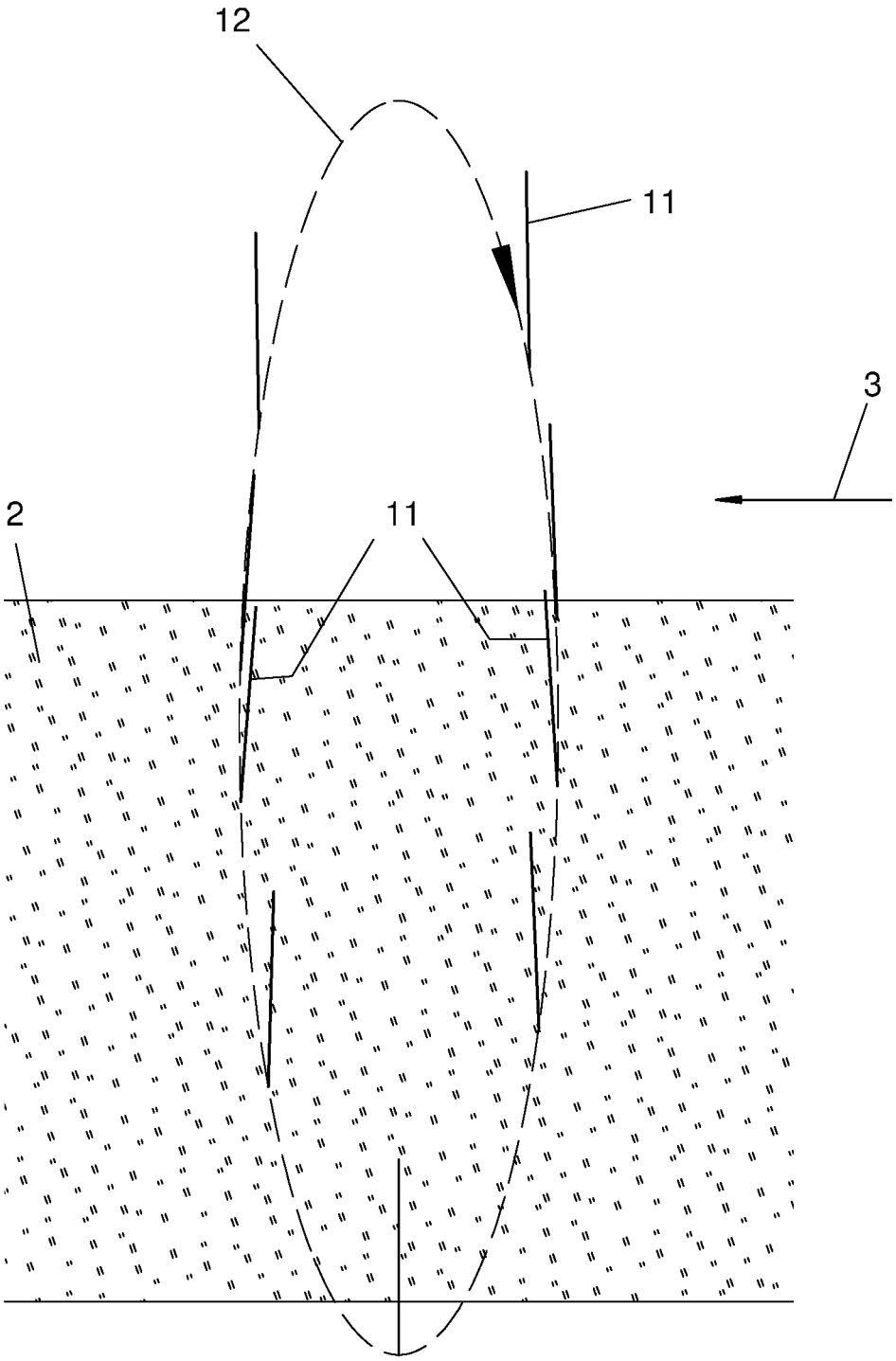
FIG. 5 is an enlarged view of an elliptical path of motion of the needle tips with representation of the needle orientation.

FIGS. 2 through 7 show a needling machine (1) according to the present invention as well as a needling unit (5) according to the present invention. FIG. 2 shows a schematic front view and FIG. 4 shows a perspective view. FIG. 5 shows an elliptical path of motion of a needle tip with reference to the nonwoven fibrous web (2). FIGS. 6 and 7 show a supporting beam (8) and the arrangement thereof at driving rods (15, 16). FIGS. 8 through 15, on the one hand, and FIG. 16 through FIG. 23, on the other hand, show a motion cycle each.

The needling machine (1) according to the present invention may contain parts of the needling machine (100) from FIG. 1.

The needling machine (1) according to the present invention has a machine frame (4) with at least one needling unit (5) and with a lifting drive (6) for the reversing drive of parallel driving rods (15, 16) guided linearly in a guide (17) for moving the needles (11). The guide (17) may have, e.g., according to FIG. 2, a plurality of, e.g., two guiding and mounting points, which are arranged at mutually spaced locations in the longitudinal direction of the rod.

The needles (11) are moved oscillatingly up and down in an, e.g., vertical lifting direction by the driving rod (15, 16) and they are inserted into a nonwoven fibrous web (2) being fed in the direction of passage (3). The needles are present in a large number, and only a few needles (11) are shown in the drawings for clarity's sake.

FIGS. 1 through 4 show the arrangement of the stripper (13) with passage openings (29) for the needles (11) plunging through. The passage openings (29) are configured according to FIG. 3 as elongated holes with an orientation in the direction of passage (3). Further, the arrangement of a stitching base (14), which likewise has openings, especially elongated holes, for receiving the needles (11) during their passage through the nonwoven web (2), is shown.

The drawings show a simplified configuration of the needling machine (1) with only one needling unit (5). In another variant, not shown, the needling machine (1) may have a multistage configuration and have a plurality of needling units (5), which are arranged one after another in the direction of passage (3). They may be located at the same machine frame (4).

The needling unit (5) shown is preferably located, when viewed in the direction of passage (3), at the starting area of a multistage needling machine (1), wherein the nonwoven fibrous web (2) being fed is not yet strengthened or is strengthened only slightly. Needling units following in the direction of passage (3) may be configured as to location in another manner, e.g., according to FIG. 1. They may act on the already at least partially strengthened nonwoven fibrous web (2) with a purely linear needle motion.

Such an arrangement with one or more needling units (5) may be present in case of a one-sided needling of the nonwoven fibrous web (2), which needling is shown as an example, and in case of an insertion and removal of the needles (11). Such an arrangement may also be used in case of a two-sided needling.

The lifting drive (6) for the driving rods (15, 16) may be driven in a freely selectable manner in the needling unit (5) according to the present invention. The needling unit (5) has, e.g., at least two preferably straight driving rods (15, 16), which are arranged one after another in the direction of passage (3), with linear guides (17) at the machine frame (4). The lifting drive (6) comprises, e.g., a respective driving mechanism (22, 23) for each driving rod (15, 16). The driving mechanisms (22, 23) are driven by a separate motor or by a common motor and by a power take-off gear. The motor is preferably configured as a controllable electric motor, especially as an alternating-current motor or three-phase motor.

The driving mechanisms (22, 23) may be configured, e.g., according to FIG. 2 and FIG. 4, as crank mechanisms and have a crank shaft (24) with a cam (25) as well as with a connecting rod (26), which is connected at its free end to the corresponding driving rod (15, 16) in an articulated manner. The configuration of the driving mechanisms may be the same as in FIG. 1, which was described above.

As an alternative, the crank mechanisms may also have a crank shaft (24) bent at right angles, as it is suggested in FIG. 2. The cam (25) is formed here by the right-angle bend of the crank shaft (24).

Figure 8:
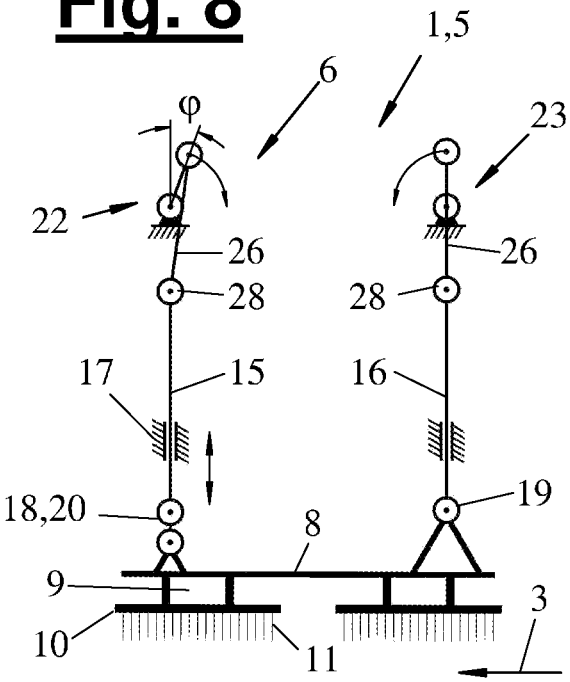
FIGS. 8, 9, 10, 11, 12, 13, 14 and 15 are schematic views showing a motion cycle of the needling unit with a beam bearing configured as an eccentric bearing in a plurality of angular positions of the lifting drive.
Figure 9:
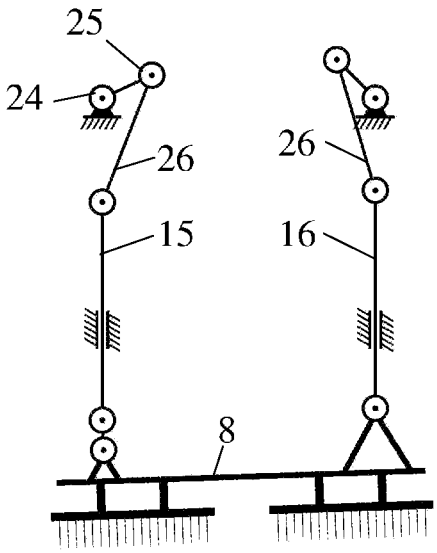
Figure 16:
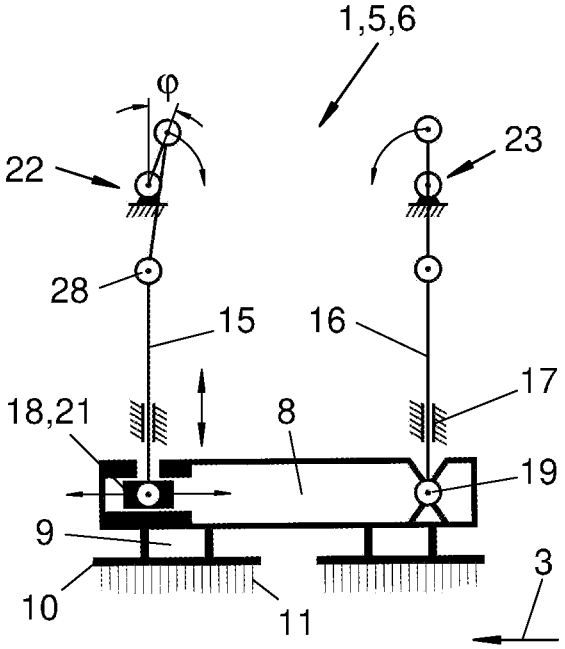
FIGS. 16, 17, 18, 19, 20, 21, 22 and 23 are schematic views showing a motion cycle with a variant of a beam bearing configured as a sliding bearing.
Figure 17:
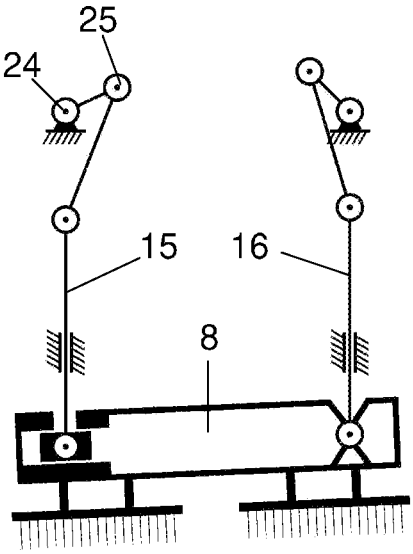
Figure 18:
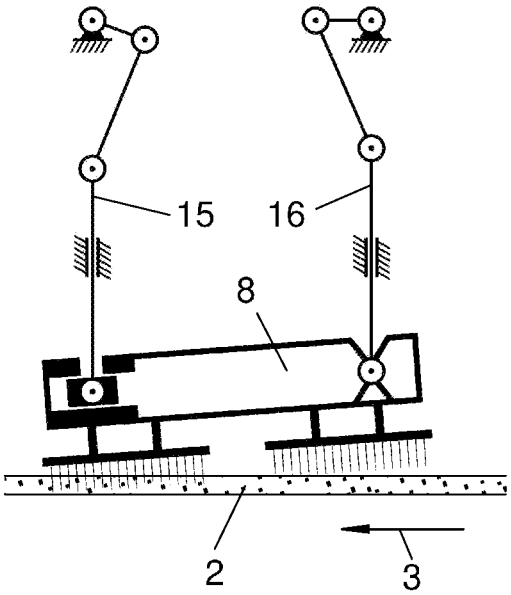
Figure 19:
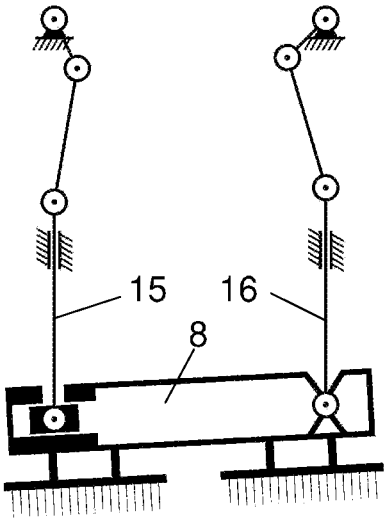
Figure 20:
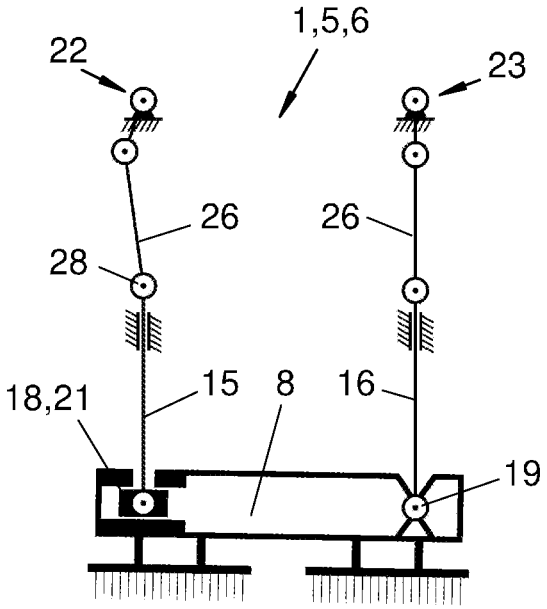
Figure 21:
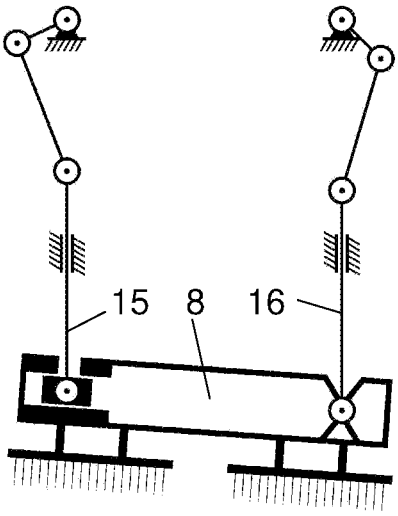
Figure 22:
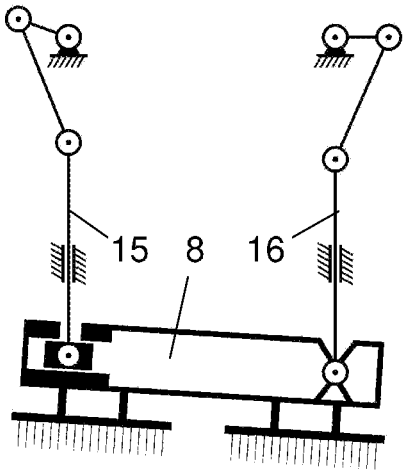
Figure 23:
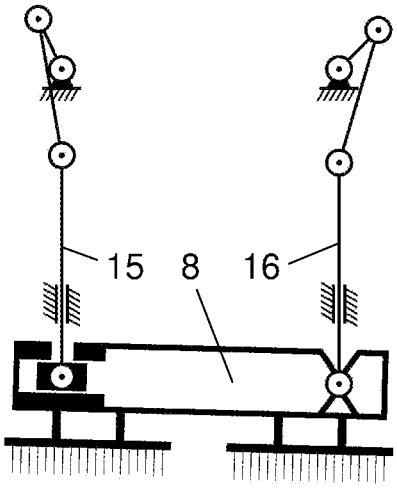

The reversing drive of the driving rods (15, 16) with the lifting and lowering motion along the longitudinal axis of the rod and along the guide (17) may take place in the same direction and in the same phase. The driving rods (15, 16) are moved now synchronously up and down. This may be the same kinematics as in FIG. 1. On the other hand, a phase-shifted motion of the driving rods (15, 16) with a phase angle (α) is possible, as it is shown in FIGS. 8 and 16. The phase angle may be, e.g., up to 30° or more.

The lifting drive (6) shown schematically in FIG. 2 may have a phase adjuster (7) for setting and, if needed, adjusting the phase angle (α). The phase adjuster (7) may have different configurations. If a common drive motor with a power take-off gear for the driving rod assembly is present, the phase adjuster (7) may be arranged, e.g., at the power take-off gear. The power take-off gear may be configured, e.g., as a gear drive or also as a toothed belt drive. For example, the phase adjustment may be carried out in case of a gear drive by shifting a helical intermediate gear. The travel of the toothed belt between the driving mechanisms (22, 23) can be changed in case of a toothed belt drive.

If the driving mechanisms (22, 23) are driven via a respective separate drive motor, the phase adjuster (2) can be arranged in a control unit of the drive motors and can set or adjust the relative phase angle or phase shift thereof. In addition, there are further possible configurations as well.

The driving rods (15, 16) are connected in the present invention to a supporting beam (8), which extends in the direction of passage (3), in an articulated manner. The driving rods (15, 16) and the supporting beam (8) are connected via a respective beam bearing (18, 19). The beam bearings (18, 19) have at least one hinge component and make possible a pivoting motion of the supporting beam (8) in relation to the respective driving rod (15, 16).

The beam bearings (18, 19) have different configurations. They have a different number of degrees of freedom of motion. The one beam bearing (18) has at least one degree of freedom of motion more than the other beam bearing (19). The beam bearing (18) having more degrees of freedom of motion is preferably arranged downstream at the supporting beam (8) when viewed in the direction of passage (3) and the other beam bearing (19) is arranged upstream.

The one beam bearing (19) with the lower number of degrees of freedom of motion is configured, e.g., as a pivot bearing with a single degree of freedom of rotatory motion. The bearing axis is arranged at right angles to the direction of passage (3) as well as to the drawing plane.

The other beam bearing (18) with the higher number of degrees of freedom of motion has a degree of freedom more in the exemplary embodiments shown. It is configured in the exemplary embodiments shown in FIGS. 2 through 7 as a rotatable eccentric bearing (20), whose bearing axes are oriented at right angles to the direction of passage (3) and parallel to the bearing axis of the other beam bearing (19). The eccentric bearing (20) is formed, e.g., by a bearing bolt of the beam bearing (18) and by a cam disk arranged thereon, which is mounted rotatably at the lower end of the driving rod. FIG. 4 shows this arrangement with a supporting beam (8) shown as a transparent supporting beam. The bearing bolts of the beam bearings (18, 19), which bearing bolts are connected to the supporting beam (8), may have an identical configuration according to FIG. 7 and be arranged at the supporting beam (8) at the same level. As an alternative, another configuration of the eccentric bearing (20) is possible. FIGS. 8 through 15 illustrates in the motion cycles this configuration of the beam bearing (18) as an eccentric bearing (20).

On the other hand, the additional degree of freedom of the beam bearing (18) may also be a degree of freedom of translatory motion. This degree of freedom may be directed along the supporting beam (8) and of the direction of passage (3). The beam bearing (18) may be configured as a sliding bearing (21) in such a configuration. The associated driving rod (15) is connected to the supporting beam (8) and mounted rotatably, on the one hand, and in said direction of the degree of freedom, on the other hand. FIGS. 16 through 23 schematically show this configuration.

The needling unit (5) according to the present invention may have a plurality of supporting beams (8) arranged one after another at right angles to the direction of passage (3) as well as driving rod pairs (15, 16) and also driving mechanisms (22, 23). FIG. 6 schematically shows such an arrangement. In a variant, not shown, a single supporting beam (8), on which two or more pairs of driving rods (15, 16) act, may be present instead of the plurality of narrow supporting beams (8) shown.

The plurality of driving rod pairs of parallel driving rods (15, 16) arranged one after another in the direction of passage (3) can be driven rotatingly by means of a common drive motor or by means of respective separate associated drive motors of the lifting drive (6). The driving rod pairs arranged one after another at right angles to the direction of passage (3) may now have a common crank shaft (24) or another common driving device.

The needles (11) may be arranged directly at the supporting beam (8) in the needling machine (1) according to the present invention and in the needling process. The supporting beam (8) may extend at right angles over the nonwoven fibrous web (2) and at right angles to the direction of passage (3). In the preferred embodiment shown, the needles (11) are connected directly to the supporting beam (8). They are mounted, e.g., according to FIGS. 6 and 7, at a needle board (10), which is connected rigidly or replaceably to a needle bar (9). The needle bar (9) is fastened to the supporting beam (8), which is preferably present as a plurality of supporting beams, and it extends, e.g., at right angles over the nonwoven fibrous web (2) and at right angles to the direction of passage (3).

The additional degree of freedom of motion of the one beam bearing (18) comes into action in case of a phase shift (α) of the reversing drive and during the oscillating motion of the driving rods (15, 16). The motions of the driving rods (15, 16) are all in one direction in case of a phase shift (α) essentially with the exception of the phases of reversal, in which case one driving rod leads in relation to the other.

For example, the driving rod (15) located downstream in the direction of passage (3) leads in relation to the driving rod (16) located upstream in the exemplary embodiment shown. This leading motion leads to an oblique position of the supporting beam (8). This is shown schematically, e.g., in FIG. 3 with a leading upwards motion of the driving rod (15), which motion is suggested by an arrow. The oblique position of the supporting beam (8) changes during a motion cycle of the lifting drive (6), especially during a 360° rotation of the driving mechanisms (22, 23). This can be seen in the motion sequences shown in FIGS. 8 through 15 and in FIGS. 16 through 23, which will be explained below.

The supporting beam (8) performs a pivoting motion about the bearing axis mentioned around the one beam bearing (19) with the lower number of degrees of freedom of motion during these cycles. The other beam bearing (18) compensates by its additional degree of freedom of motion the changing oblique positions and also the distances of the coupling points of the driving rods (15, 16) at the supporting beam (8), which distances change due to the phase shift.

For example, the driving rod (15) located downstream in the direction of passage (3) leads in case of said phase shift (α) by said phase angle (α) of the other driving rod (16) in the motion direction. The beam bearing (18) with the additional degree of freedom of motion is preferably also arranged at the leading driving rod (15).

The driving mechanisms (22, 23) rotate in opposite directions in the exemplary embodiments and motion cycles shown, which is advantageous from the viewpoint of vibrations. The direction of rotation is selectable. The leading driving mechanism (22) rotates, e.g., clockwise and the other driving mechanism (23) counterclockwise. The direction of rotation can be reversed.

In another kinematic variant, the driving mechanisms may rotate in opposite directions. Additional kinematic parameters, e.g., the directions of the phase shift and phase angle (α), are variable.

FIG. 8 shows a motion cycle with an eccentric bearing (20). In the initial position shown in FIG. 8, the driving mechanism (22) and the connecting rod (26) as well as the driving rod (15) have already moved by the angle (α) in the direction of rotation shown from the stretched position of the connecting rod (26) and of the driving rod (15). The other driving rod (16) and its connecting rod (26) still assume this stretched position. FIGS. 9 through 15 show the additional phases of motion with an advancement of the rotation and of the angle by 45° each.

Figure 10:
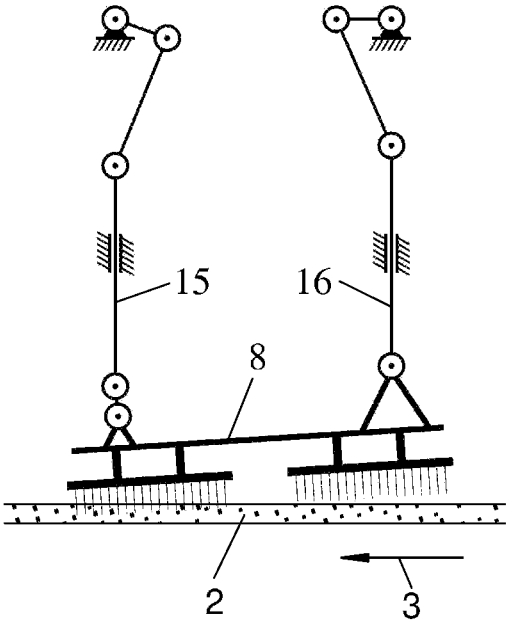
Figure 11:
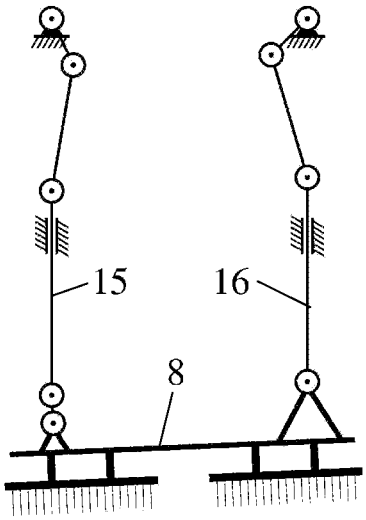
Figure 12:
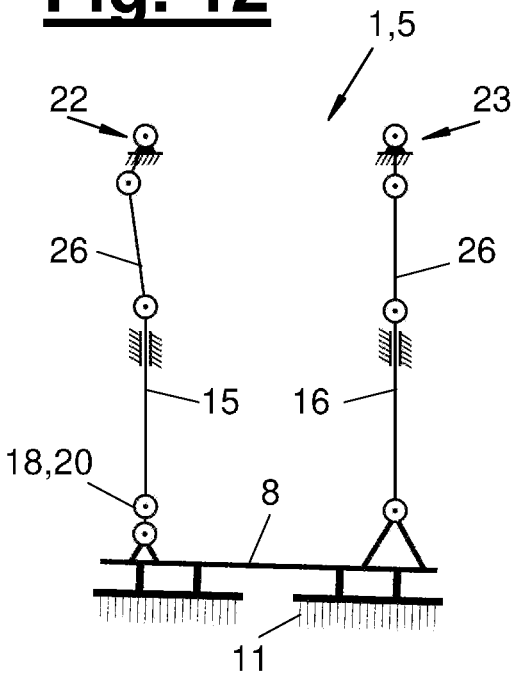
Figure 13:
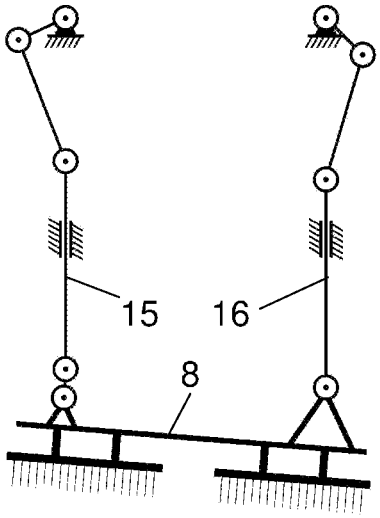
Figure 14:
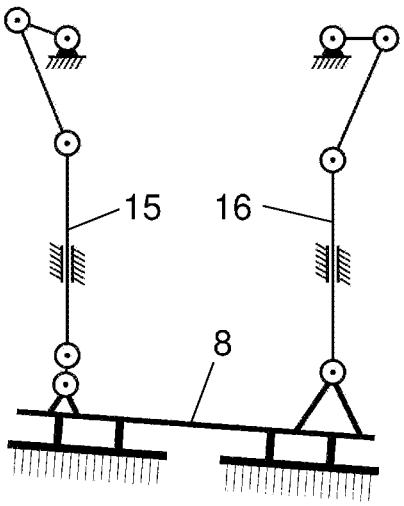
Figure 15:
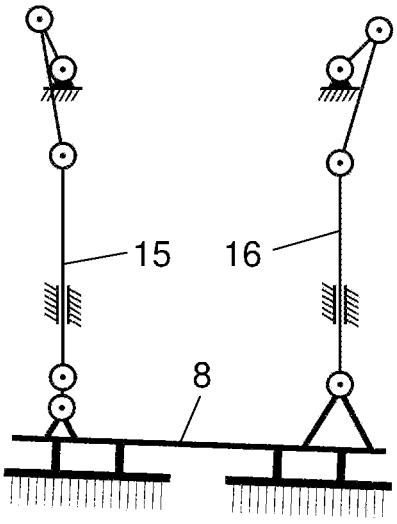

In the initial position shown in FIG. 8, the supporting beam (8) already assumes a slightly oblique position in relation to its normal parallel orientation to the direction of passage (3). The oblique position changes and increases over the additional drive and crank path shown in FIGS. 9 through 11 and the supporting beam (8) is sloped downwards when viewed in the direction of passage (3) towards the nonwoven fibrous web (2). The downstream end of the supporting beam (8) and the driving rod (15) lead during the downstroke and are closer to the nonwoven fibrous web (2) than is the upstream end of the supporting beam and the driving rod (16). FIG. 10 shows the insertion of the nonwoven fibrous web (2).

Depending on the rotatory or angular position, the oblique position gradually becomes greater and then it becomes smaller again. After an angle of rotation and drive angle of about 180°, the oblique position reverses according to FIGS. 12 through 15 and the supporting beam (8) is directed obliquely upwards in relation to the direction of passage (3). Beginning from this reversal, the driving rod (15) leads in the upwards motion of the other driving rod (16). At the end of the cycle in FIG. 15, the supporting beam (8) is again essentially parallel to the direction of passage (3) and is oriented towards the nonwoven fibrous web (2) being guided along a straight path.

FIGS. 16 through 23 show the same motion cycle at the same 45° increments and illustrate the motions of the sliding bearing (21).

FIGS. 8 through 23 show, in addition, a variant in the configuration of the supporting beam (8), of the needle bar (9) and of the needle board (10). Two needle bars (9) with a respective needle board (10) each are arranged one after another in the direction of passage (3) at the supporting beam (8) connecting the driving rods (15, 16) on the side pointing away from the driving rods (15, 16), especially on the underside. A single and common needle bar (9) with needle board (10) is shown in the variant according to FIGS. 6 and 7.

FIGS. 3 and 5 show the path of motion (12) of the needles (11), which is performed during the above-mentioned motion cycles shown in FIGS. 8 through 23. An elliptical path of motion (12) of the needle tips of the needles (11) is obtained due to the oscillating lifting and lowering motion along the lifting direction and the superimposed pivoting motion of the supporting beam (8). The needle tips are inserted into the preferably continuously moving nonwoven fibrous web (2) upstream when viewed in the direction of passage (3) and leave the nonwoven fibrous web (2) downstream again. They move in the process over their path of motion (12) in some areas with low resistance together with the nonwoven fibrous web (2) in the direction of passage (3). The slope of the needles (11) changes only slightly over the elliptical path of motion (12).

As an alternative or in addition, a two-sided needling of the nonwoven fibrous web (2) is possible. An additional needling unit (5) may be arranged in this case on the other side, e.g., on the underside, of the nonwoven fibrous web (2). The stitching base (14) can be eliminated thereby and replaced by the additional needling unit (5) and the stripper (13) thereof. The two-sided needling units (5) preferably operate with a mutual phase shift of, e.g., 180°, so that the needles (11) of one needling unit (5) are inserted into the nonwoven fibrous web (2) while the needles (11) of the other needling unit (5) are already leaving or have left the fibrous web (2).

Various variants of the exemplary embodiments shown and described are possible. The arrangement of the beam bearings (18, 19), which is related to the direction of passage (3), may be reversed, and the beam bearings (19) located upstream will thus have the additional degree of freedom of motion. The phase shift (α) between the driving rods (15, 16) may also be changed and, e.g., reversed, and, e.g., the driving rod (16) located upstream will lead in this case in relation to the driving rod (15) located downstream.

Further, possibilities of variation pertain to the configuration of the lifting drive (6). A translatory drive may be present instead of the shown rotatory drive of the oscillating driving rods (15, 16). In addition, there are additional possibilities of configuration for the lifting drive (6).

While specific embodiments of the invention have been shown and described in detail to illustrate the application of the principles of the invention, it will be understood that the invention may be embodied otherwise without departing from such principles.

LIST OF REFERENCE NUMBERS

1 Needling machine
2 Fibrous web, nonwoven
3 Direction of passage
4 Machine frame
5 Needling unit
6 Lifting drive
7 Phase adjuster
8 Supporting beam
9 Needle bar
10 Needle board
11 Needle
12 Path of motion
13 Stripper
14 Stitching base
15 Driving rod

16 Driving rod
17 Guide
18 Beam bearing
19 Beam bearing
20 Eccentric bearing
21 Sliding bearing
22 Driving mechanism, crank mechanism
23 Driving mechanism, crank mechanism
24 Crank shaft
25 Cam
26 Connecting rod
27 Connecting rod bearing
28 Hinge
29 Passage opening

What is claimed is:

1. A needling machine for a nonwoven fibrous web fed in a direction of passage, the needling machine comprising a needling unit comprising:

oscillatingly moved needles configured to needle and strengthen the nonwoven fibrous web;

a lifting drive;

parallel and linearly guided driving rods reversably driven by the lifting drive in a reversing manner;

a supporting beam connected to the needles and extending in the direction of passage; and beam bearings, wherein each of the driving rods, arranged one after another in the direction of passage, is articulatedly connected to the supporting beam via a respective one of the beam bearings, wherein one of the beam bearings, which are arranged one after another in the direction of passage, has an additional degree of freedom of motion.

2. A needling machine in accordance with claim 1, wherein:

one of the beam bearings is a downstream beam bearing arranged at the supporting beam downstream in the direction of passage; and the downstream beam bearing has the additional degree of freedom of motion.

3. A needling machine in accordance with claim 1, wherein the beam bearing with the additional degree of freedom of motion is configured as an eccentric bearing or as a sliding bearing.

4. A needling machine in accordance with claim 1, wherein:

the needling unit further comprises straight and upright guides; and each of the straight and upright guides is provided for a respective one of the driving rods.

5. A needling machine in accordance with claim 1, wherein:

the parallel and linearly guided driving rods comprise two parallel driving rods;

the beam bearings comprise two beam bearings; and the supporting beam is connected to the two parallel driving rods via the two beam bearings.

6. A needling machine in accordance with claim 1, wherein the lifting drive drives the driving rods in the same direction.

7. A needling machine in accordance with claim 1, wherein:

the lifting drive drives the driving rods with a mutual phase shift;

the lifting drive has a phase adjuster for setting the phase shift or setting the phase shift and adjusting the phase shift.

8. A needling machine in accordance with claim 1, wherein the lifting drive comprises a separate driving mechanism each for one of the driving rods, which are arranged one after another in the direction of passage.

9. A needling machine in accordance with claim 8, wherein the driving mechanisms are configured as rotating crank mechanisms.

10. A needling machine in accordance with claim 9, wherein the crank mechanisms are driven such that the crank mechanisms rotate in opposite directions.

11. A needling machine in accordance with claim 8, wherein the driving mechanisms are reversably driven by a predefined angle of rotation or in a circulatingly.

12. A needling machine in accordance with claim 8, wherein the lifting drive compirses a common drive motor or a respective separate drive motor each for the driving mechanisms.

13. A needling machine in accordance with claim 1, wherein the needling unit further comprises: at least another supporting beam to provide two or more supporting beams; and at least another driven pair of driving rods, which are arranged one after another at right angles to the direction of passage.

14. A needling machine in accordance with claim 1, wherein the needling unit further comprises a needle bar with a needle board and with needles, the needle bar being arranged at the supporting beam.

15. A needling machine in accordance with claim 7, wherein the supporting beam performs a wobbling motion about the one of the beam bearings in case of the phase shift.

16. A needling machine in accordance with claim 7, wherein:

the needling unit further comprises a needle bar with a needle board and with needles, the needle bar being connected to the supporting beam; and the needles have an elliptical path of motion in case of the phase shift.

17. A needling machine in accordance with claim 1, further comprising another needling unit wherein the needling machine comprises a plurality of needling units, which are arranged on both above and under sides of the nonwoven fibrous web.

18. A process for needling and strengthening a nonwoven fibrous web, which nonwoven fibrous web is fed to a needling machine in a direction of passage, wherein the needling machine comprises a needling unit with oscillatingly moved needles for needling and strengthening the nonwoven fibrous web, wherein the needling unit comprises a lifting drive and parallel, linearly guided driving rods reversably driven thereby for moving the needles, the process comprising:

providing the needling unit with a supporting beam, which is connected to the needles and which extends in the direction of passage;

arranging the driving rods one after another in the direction of passage and articulatedly connecting each of the driving rods to the supporting beam via a beam bearing; and providing one of the beam bearings, arranged one after another in the direction of passage, with an additional degree of freedom of motion.

19. A process in accordance with claim 18, wherein:

the lifting drive drives the driving rods with a mutual phase shift; and the supporting beam performs a wobbling motion about a beam bearing without the additional degree of freedom of motion in case of the phase shift.

20. A process in accordance with claim 18, wherein:

the lifting drive drives the driving rods with a mutual phase shift; and the needles have an elliptical path of motion in case of the phase shift.

* * * * *